US009181777B2

(12) United States Patent
Hebert et al.

(10) Patent No.: US 9,181,777 B2
(45) Date of Patent: Nov. 10, 2015

(54) ANNULAR PRESSURE RELEASE SUB

(75) Inventors: John Emile Hebert, Houma, LA (US); Brandon Lee Bourg, Houma, LA (US); Emmet J. Arboneaux, III, Thibodaux, LA (US); Joshua T. Smith, Spring, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 313 days.

(21) Appl. No.: 13/458,254

(22) Filed: Apr. 27, 2012

(65) Prior Publication Data

US 2012/0273226 A1 Nov. 1, 2012

Related U.S. Application Data

(60) Provisional application No. 61/481,052, filed on Apr. 29, 2011.

(51) Int. Cl.
*E21B 34/06* (2006.01)
*E21B 34/08* (2006.01)

(52) U.S. Cl.
CPC ..... *E21B 34/06* (2013.01); *E21B 34/08* (2013.01)

(58) Field of Classification Search
CPC ..... E21B 2034/00; E21B 2034/002; E21B 2034/005; E21B 2034/007; E21B 34/00; E21B 34/06; E21B 34/08
USPC ..... 166/319, 325, 373
See application file for complete search history.

(56) References Cited

U.S. PATENT DOCUMENTS

| | | | | |
|---|---|---|---|---|
| 1,793,193 | A | 2/1931 | Price | |
| 2,251,977 | A | 8/1941 | Burt | |
| 2,509,839 | A | 5/1950 | Panner | |
| 3,193,016 | A | 7/1965 | Knox | |
| 3,223,109 | A | 12/1965 | Cummings | |
| 3,282,289 | A | 11/1966 | Vick | |
| 3,292,706 | A | 12/1966 | Grimmer et al. | |
| 3,294,108 | A | 12/1966 | Thrash | |
| 3,583,481 | A | 6/1971 | Vernotzy | |
| 3,606,926 | A | 9/1971 | Schwegman | |
| 3,633,671 | A | 1/1972 | Nelson | |
| 3,640,501 | A | 2/1972 | Walton | |
| 3,789,926 | A | 2/1974 | Henley et al. | |
| 3,807,444 | A | 4/1974 | Fortune | |
| 4,049,057 | A * | 9/1977 | Hewes | 166/304 |

(Continued)

FOREIGN PATENT DOCUMENTS

| | | | |
|---|---|---|---|
| GB | 2290319 | A | 12/1995 |
| WO | 2010089728 | A2 | 8/2010 |

OTHER PUBLICATIONS

PCT International Search Report and Written Opinion dated Sep. 5, 2013, International Application No. PCT/2012/035598.

(Continued)

*Primary Examiner* — Brad Harcourt
(74) *Attorney, Agent, or Firm* — Patterson & Sheridan, LLP

(57) ABSTRACT

A method and apparatus for a pressure relief valve assembly. The valve assembly may be coupled to one or more casings and/or tubular members to control fluid communication therebetween. The valve assembly is a one-way valve assembly that relieves pressure within an annulus formed between adjacent casings and/or tubular members to prevent burst or collapse of the casings and/or tubular members. The valve assembly is resettable downhole.

23 Claims, 8 Drawing Sheets

(56) References Cited

U.S. PATENT DOCUMENTS

| | | | | |
|---|---|---|---|---|
| 4,201,364 | A | 5/1980 | Taylor | |
| 4,602,684 | A | 7/1986 | Van Wormer et al. | |
| 5,263,683 | A | 11/1993 | Wong | |
| 5,271,428 | A | 12/1993 | Dunn et al. | |
| 5,316,084 | A | 5/1994 | Murray et al. | |
| 5,372,193 | A | 12/1994 | French | |
| 5,411,095 | A | 5/1995 | Ehlinger et al. | |
| 5,501,280 | A * | 3/1996 | Brisco | 166/373 |
| 6,059,038 | A | 5/2000 | Vick, Jr. | |
| 6,230,811 | B1 | 5/2001 | Ringgenberg et al. | |
| 6,296,061 | B1 | 10/2001 | Leismer | |
| 6,457,528 | B1 | 10/2002 | Staudt | |
| 6,725,937 | B1 | 4/2004 | McHardy | |
| 6,899,126 | B2 | 5/2005 | Weigand et al. | |
| 7,191,830 | B2 | 3/2007 | McVay et al. | |
| 7,240,739 | B2 * | 7/2007 | Schoonderbeek et al. | 166/386 |
| 7,467,664 | B2 | 12/2008 | Cochran et al. | |
| 7,669,661 | B2 | 3/2010 | Johnson | |
| 8,276,618 | B2 | 10/2012 | Cewers | |
| 8,544,554 | B2 | 10/2013 | Schultz et al. | |
| 8,752,631 | B2 | 6/2014 | Stewart | |
| 2003/0070713 | A1 | 4/2003 | Cornea et al. | |
| 2004/0045605 | A1 | 3/2004 | Floh et al. | |
| 2005/0189107 | A1 * | 9/2005 | McVay et al. | 166/242.1 |
| 2006/0037645 | A1 | 2/2006 | Boldt et al. | |
| 2008/0000633 | A1 | 1/2008 | Xu et al. | |
| 2008/0121397 | A1 | 5/2008 | Galloway et al. | |
| 2008/0149200 | A1 | 6/2008 | Burkhard et al. | |
| 2009/0025930 | A1 | 1/2009 | Iblings et al. | |
| 2009/0056948 | A1 | 3/2009 | Martin et al. | |
| 2009/0133869 | A1 | 5/2009 | Clem | |
| 2011/0000679 | A1 | 1/2011 | Joseph et al. | |
| 2011/0114333 | A1 * | 5/2011 | Fenton | 166/373 |
| 2011/0278016 | A1 | 11/2011 | Xu | |
| 2013/0068532 | A1 | 3/2013 | Bansal et al. | |

OTHER PUBLICATIONS

Australian Patent Examination Report dated Mar. 16, 2015 for Australian Application No. 2012249426.

Canadian Office Action dated Dec. 17, 2014 for Patent Application No. 2,834,293.

Canadian Office Action dated Sep. 23, 2014 for Application No. 2,834,227.

PCT International Search Report and Written Opinion for International Application No. PCT/US2012/035604 dated Sep. 5, 2013.

PCT Search Report and Written Opinion for International Application No. PCT/US2012/035589 dated Aug. 28, 2013.

PCT Search Report and Written Opinion for International Application No. PCT/US2012/035606 dated Aug. 16, 2013.

Australian Examination Report for Patent Application No. 2012249434 dated Jul. 1, 2015.

* cited by examiner

ANNULAR PRESSURE RELEASE SUB

CROSS-REFERENCE TO RELATED APPLICATIONS

This application claims benefit of U.S. provisional patent application Ser. No. 61/481,052, filed Apr. 29, 2011, which is herein incorporated by reference in its entirety.

BACKGROUND OF THE INVENTION

1. Field of the Invention

Embodiments of the invention generally relate to a pressure relief valve assembly.

2. Description of the Related Art

Traditional well construction, such as the drilling of an oil or gas well, includes a wellbore or borehole being drilled through a series of formations. Each formation, through which the well passes, must be sealed so as to avoid an undesirable passage of formation fluids, gases or materials out of the formation and into the borehole. Conventional well architecture includes cementing casings in the borehole to isolate or seal each formation. The casings prevent the collapse of the borehole wall and prevent the undesired inflow of fluids from the formation into the borehole.

In standard practice, each succeeding casing placed in the wellbore has an outside diameter significantly reduced in size when compared to the casing previously installed. The borehole is drilled in intervals whereby a casing, which is to be installed in a lower borehole interval, is lowered through a previously installed casing of an upper borehole interval and then cemented in the borehole. The purpose of the cement around the casing is to fix the casing in the well and to seal the borehole around the casing in order to prevent vertical flow of fluid alongside the casing towards other formation layers or even to the earth's surface.

If the cement seal is breached, due to high pressure in the formations and/or poor bonding in the cement for example, fluids (liquids or gases) may begin to migrate up the borehole. The fluids may flow into the annuli between previously installed casings and cause undesirable pressure differentials across the casings. The fluids may also flow into the annuli between the casings and other drilling or production tubular members that are disposed in the borehole. Some of the casings and other tubulars, such as the larger diameter casings, may not be rated to handle the unexpected pressure increases, which can result in the collapse or burst of a casing or tubular.

Therefore, there is a need for apparatus and methods to prevent wellbore casing and tubular failure due to unexpected downhole pressure changes.

SUMMARY OF THE INVENTION

In one embodiment, a valve assembly comprises a tubular mandrel having a seat portion; a plug member coupled to the tubular mandrel; and a biasing member operable to bias the plug member against the seat portion, wherein the plug member is movable between a closed position where fluid communication is closed between a bore of the valve assembly and an annulus surrounding the valve assembly and an open position where fluid communication is open between the bore of the valve assembly and the annulus surrounding the valve assembly.

In one embodiment, a method of controlling fluid communication between an exterior of a wellbore tubular and an interior of the wellbore tubular comprises providing a valve assembly for coupling to the wellbore tubular, wherein the valve assembly includes a tubular mandrel, a plug member movably coupled to the tubular mandrel, and a biasing member for biasing the plug member into a closed position; and moving the plug member to an open position to open fluid communication between the exterior of the wellbore tubular and the interior of the wellbore in response to a predetermined pressure differential.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
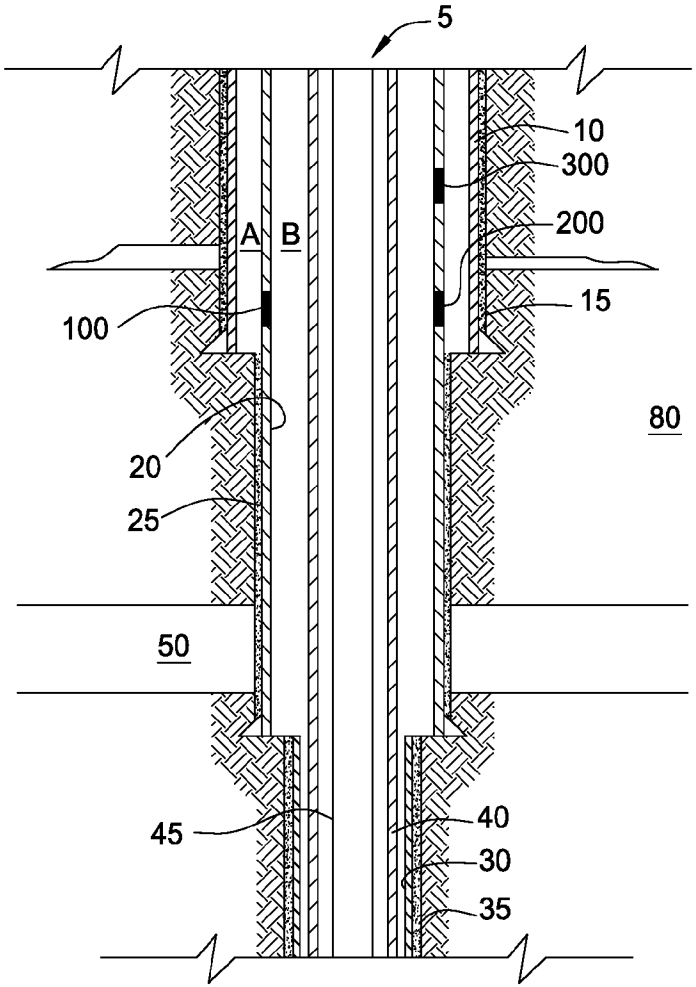
FIG. 1 is a schematic view of a wellbore.

FIG. 1 illustrates a wellbore 5 formed within an earthen formation 80. The walls of the wellbore 5 are reinforced with a plurality of casings 10, 20, 30 of varying diameters that are structurally supported within the formation 80. The casings 10, 20, 30 are fixed within the formation 80 using a sealing material 15, 25, 35, such as cement, which prevents the migration of fluids from the formation 80 into the annuli between the casings 10, 20, 30. One or more tubular members 40, 45, such as drilling or production tubular members, may also be disposed in the wellbore 5 for conducting wellbore operations. An annulus "A" is formed between the casing 10 and the casing 20, and an annulus "B" is formed between the casing 20 and the tubular member 40. It is important to note that the embodiments described herein may be used with other wellbore arrangements and are not limited to use with the wellbore configuration illustrated in FIG. 1.

The wellbore 5 may intersect a high pressure zone 50 within the formation 80. Fluids within the high pressure zone 50 are sealed from the annulus A and B by the sealing material 25 that is disposed between the casing 20 and the wellbore 5 wall. In the event that the sealing material 25 is breached or otherwise compromised, pressurized fluids may migrate upward into the annulus A and cause an unexpected pressure increase. The pressure rise may form a pressure differential across the casings 10, 20 that (if unchecked) may result in leakage through or burst of casing 10, and/or leakage through or collapse of casing 20. One or more valve assemblies 100, 200, 300 are provided to relieve the pressure in the annulus A prior to failure of one or both of the casings 10, 20.

Figure 2:
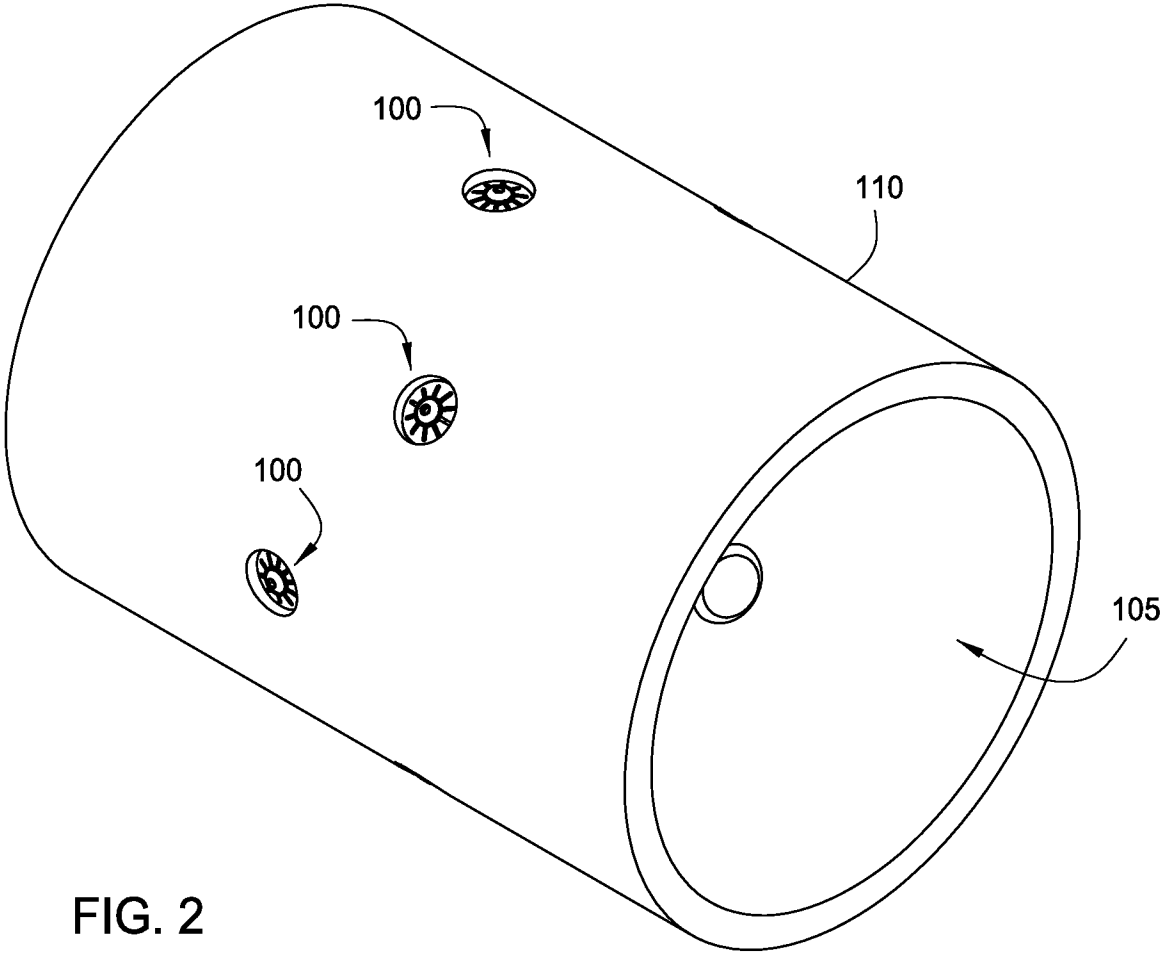
FIG. 2 is a perspective view of a valve assembly.

FIG. 2 illustrates a plurality of valve assemblies 100 disposed about the circumference of a tubular mandrel 110. The valve assemblies 100 are shown coupled to the casing 20 in FIG. 1, but each of the casings 10, 20, 30 and/or the tubular members 40, 45 may similarly include one or more of the valve assemblies 100 as described herein. The valve assemblies 100 may be coupled directly to the casings 10, 20, 30 and/or the tubular members 40, 45, or may be coupled to the tubular mandrel 110, which may be coupled to the casings 10, 20, 30 and/or the tubular members 40, 45 using a threaded connection, a welded connection, and/or other similar connection arrangements. In one embodiment, the inner diameter of the tubular mandrel 110 may be substantially equal to or greater than the inner diameter of the casings 10, 20, 30 and/or the tubular members 40, 45 to which it is attached when assembled.

Figure 3B:
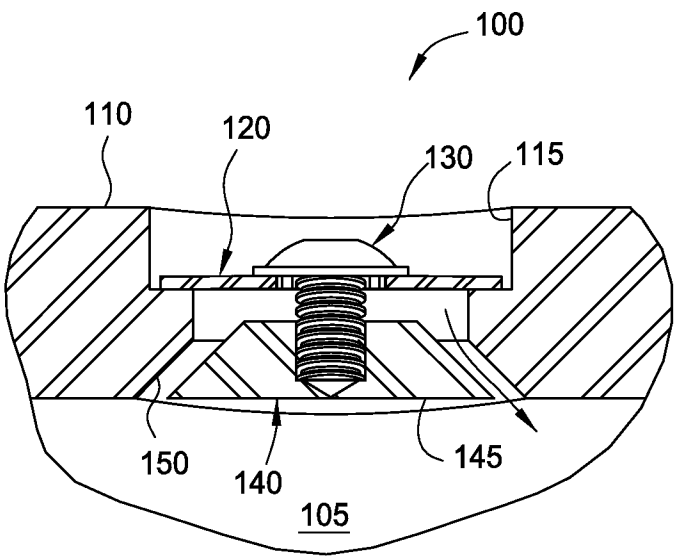
FIGS. 3A and 3B are cross sectional views of the valve assembly in a closed position and an open position.
Figure 3A:
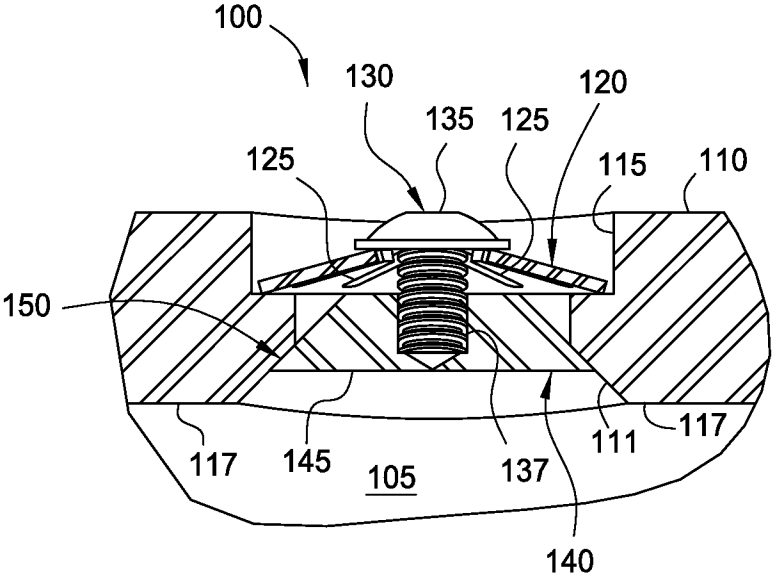

FIG. 3A illustrates the valve assembly 100 in a closed position. The valve assembly 100 may be disposed in a recess 115 of the tubular mandrel 110 and may comprise a biasing member 120, a retaining member 130, a plug member 140, and a valve seat 150. The retaining member 130 is coupled to the plug member 140 and is biased outwardly from the recess 115 by the biasing member 120 to force the plug member 140 against the valve seat 150. The plug member 140 forms a seal with the valve seat 150 to prevent fluid communication between a bore 105 of the tubular member 110 and the annulus surrounding the valve assembly 100. The plug member 140 includes a tapered sealing surface that engages a corresponding tapered sealing surface of the valve seat 150. In one embodiment, the sealing surfaces of the plug member 140 and the valve seat 150 may be substantially parallel to the inner surface 117 of the tubular mandrel 110. The valve seat 150 may be part of a recess 111 formed in the inner surface 117 of the tubular mandrel 110, which is in communication with the recess 115. When the valve assembly 100 is in the closed position, the inner surface 145 of the plug member 140 may be recessed with respect to the inner surface 117 of the tubular mandrel 110 to prevent interference with any component(s) that may be moved through the bore 105 of the tubular mandrel 110.

In one embodiment, the retaining member 130 may include a cap portion 135 configured to retain the biasing member 120 within the recess 115, and may further include a shaft portion 137 that is connected to the plug member 140. In one embodiment, the retaining member 130 may be a fastening screw. In this manner, the plug member 140 is seated against the valve seat 150 by the bias force of the biasing member 120 applied to the retaining member 130. In one embodiment, the biasing member 120 may include a disc spring having one or more slots 125 disposed through the body of the disc spring. The slots 125 facilitate fluid flow through the biasing member 120 and thus the valve assembly 100 when moved to the open position.

Figure 4:
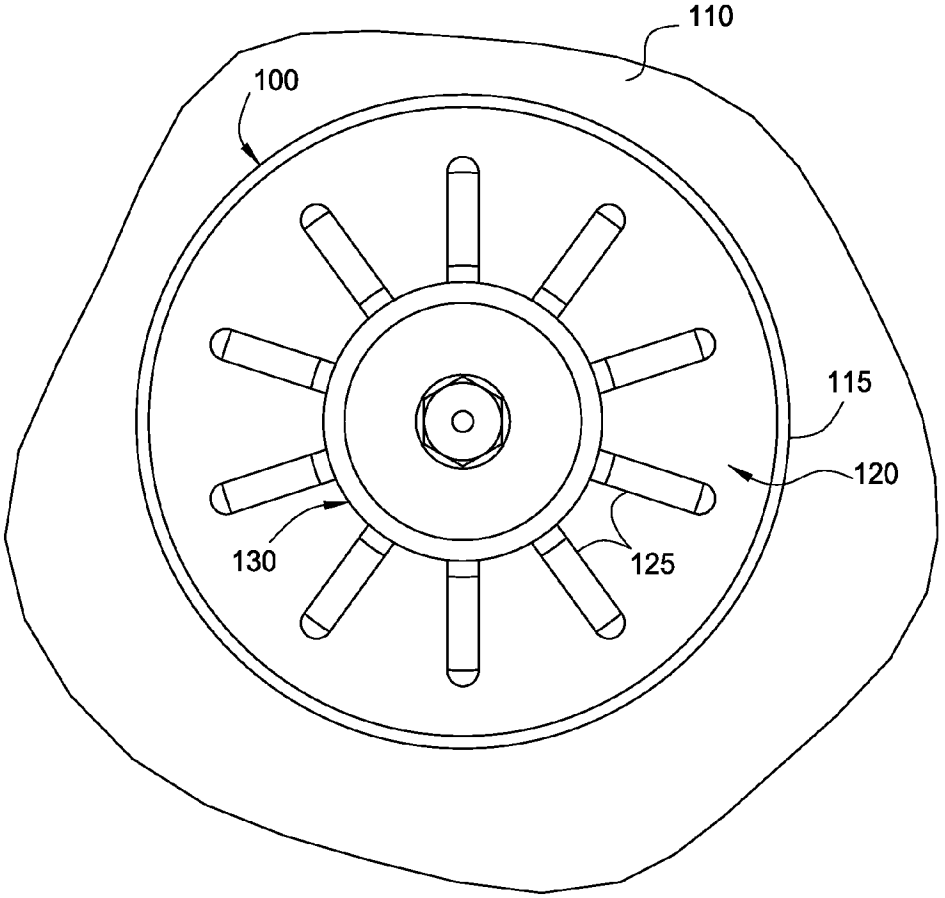
FIG. 4 is a top view of the valve assembly.

As shown in FIG. 4, a top view of the valve assembly 100 within the recess 115 illustrates a plurality of slots 125 radially disposed about the inner circumference of the biasing member 120. The retaining member 130 is disposed through a central opening in the biasing member 120 and engages the upper surface portions between the slots 125. Other retaining member 130 and biasing member 120 arrangements may be used with the embodiments described herein.

FIG. 3B illustrates the valve assembly 100 in the open position, where the bore 105 of the tubular mandrel 110 is in fluid communication with the annulus surrounding the valve assembly 100. The pressure in the annulus surrounding the valve assembly 100 may generate a force on the outer surfaces of the biasing member 120, the retaining member 130, and/or the plug member 140 sufficient to overcome the closure force on the valve assembly 100. The closure force on the valve assembly 100 may include the force from the biasing member 120, such as a spring force, plus the force generated by any pressure within the bore 105 acting on the inner surface 145 of the plug member 140.

As illustrated in FIG. 3B, the biasing member 120 is compressed, and the retaining member 130 and the plug member 140 are moved to open fluid communication to the bore 105 of the tubular mandrel 110. The plug member 140 is moved inwardly toward the bore 105 and away from contact with the valve seat 150. Fluid may flow through the slots 125 and between the plug member 140 and the valve seat 150 into the bore 105. When in the open position, the inner surface 145 of the plug member 140 may be substantially flush with respect to the inner surface 117 of the tubular mandrel 110. In other embodiments, when in the open position, the plug member 140 may be recessed with respect to the inner surface 117 of the tubular mandrel 110 or may at least partially protrude into the bore 105.

Figure 3C:
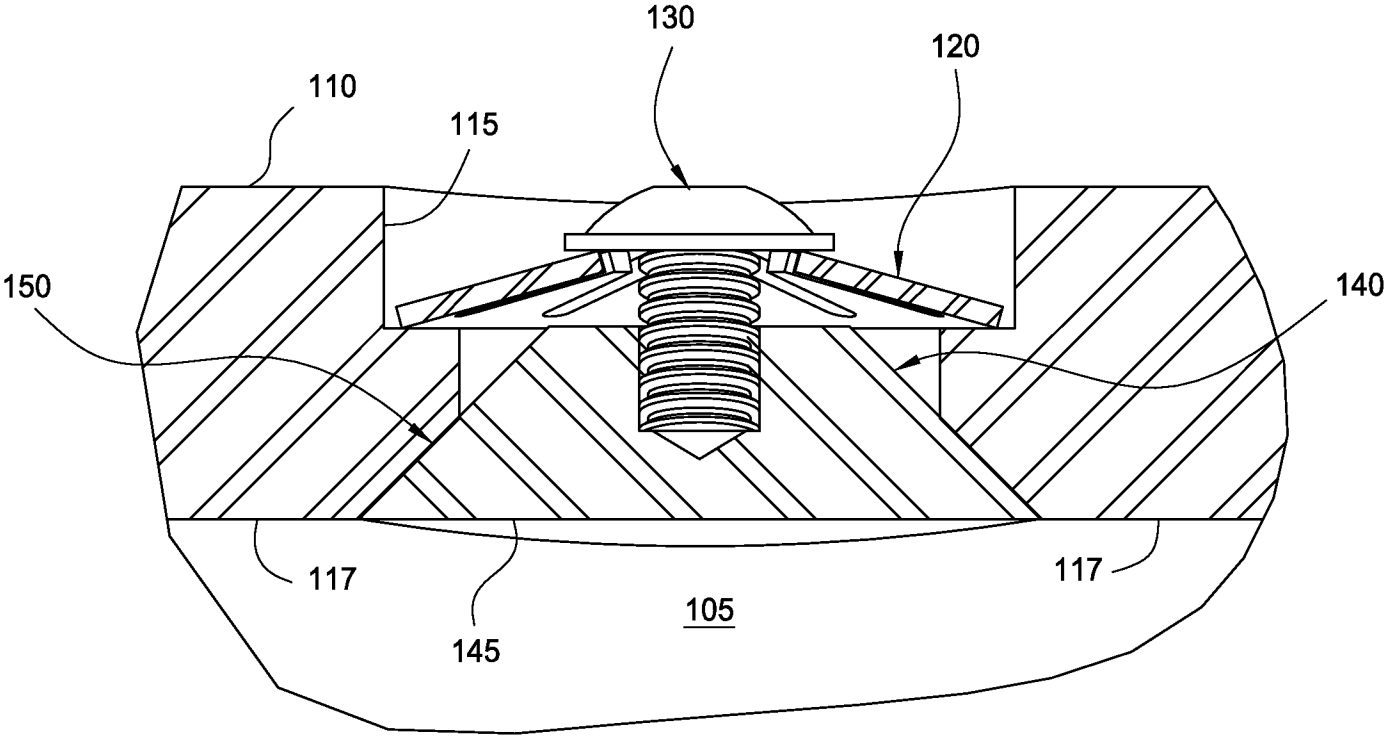
FIG. 3C is a cross sectional view of the valve assembly in the closed position.

FIG. 3C illustrates an embodiment of the valve assembly 100 in the closed position, where the inner surface 145 of the plug member 140 is substantially flush with the inner surface 117 of the tubular mandrel 110. When in the closed position, the plug member 140 does not interfere with any component(s) that may be moved through the bore 105 of the tubular mandrel 110. When in the open position, the plug member 140 may be moved to a position where it is partially disposed within the bore 105 of the tubular mandrel 110.

Figure 5B:
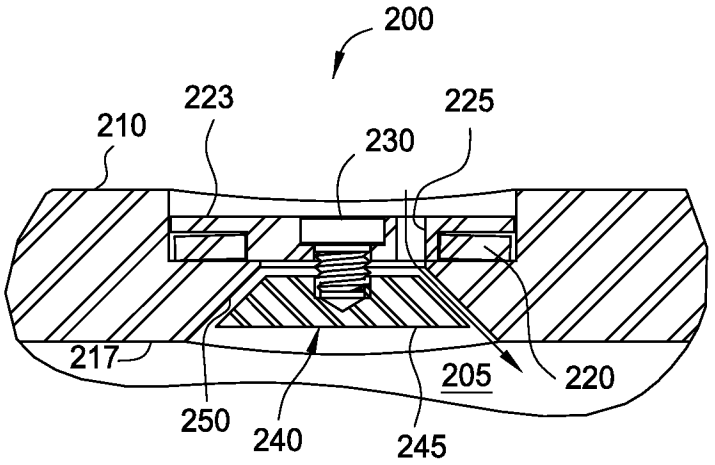
FIGS. 5A and 5B are cross sectional views of a valve assembly in a closed position and an open position.
Figure 5A:
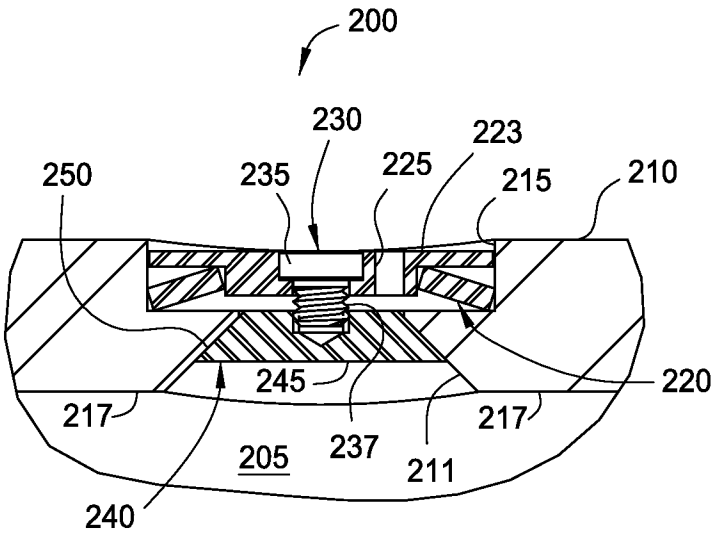

FIG. 5A illustrates a valve assembly 200 in a closed position. The valve assembly 200 operates in a similar manner as the valve assembly 100, and the similar components are identified with the same reference numerals but having a "200" series designation. The valve assembly 200 may be disposed in a recess 215 of a tubular mandrel 210 and may comprise a biasing member 220, a retaining member 230, a plug member 240, and a valve seat 250. The valve assembly 200 further comprises a cover member 223 for retaining the biasing member 220 within the recess 215.

The retaining member 230 is coupled to the cover member 223. The retaining member 230 is also coupled to the plug member 240 and is biased outwardly from the recess 215 via the cover member 223 by the biasing member 220 to force the plug member 240 against the valve seat 250. The plug member 240 forms a seal with the valve seat 250 to prevent fluid communication between a bore 205 of the tubular member 210 and the annulus surrounding the valve assembly 200. The plug member 240 includes a tapered sealing surface that engages a corresponding tapered sealing surface of the valve seat 250. The valve seat 250 may be part of a recess 211 formed in the inner surface 217 of the tubular mandrel 210, which is in communication with the recess 215. When the valve assembly 200 is in the closed position, the inner surface 245 of the plug member 240 may be recessed and not flush with respect to the inner surface 217 of the tubular mandrel 210 to prevent interference with any component(s) that may be moved through the bore 205 of the tubular mandrel 210. In one embodiment, the inner surface 245 of the plug member 240 may be flush with the inner surface 217 of the tubular mandrel 210 as similarly illustrated in FIG. 3C with respect to plug member 140.

In one embodiment, the retaining member 230 may include a cap portion 235 for coupling to the cover member 223, and may further include a shaft portion 237 that is threadedly connected to the plug member 240. In one embodiment, the retaining member 230 may be a fastening screw. In this manner, the plug member 240 is seated against the valve seat 250 by the bias force of the biasing member 220 applied to the cover member 223. In one embodiment, the biasing member 220 may include a disc spring. In one embodiment, the cover member 223 may include one or more ports 225 disposed through the body of the cover member 223. The ports 225 facilitate fluid flow through the cover member 223 and thus the valve assembly 200 when moved to the open position.

Figure 6:
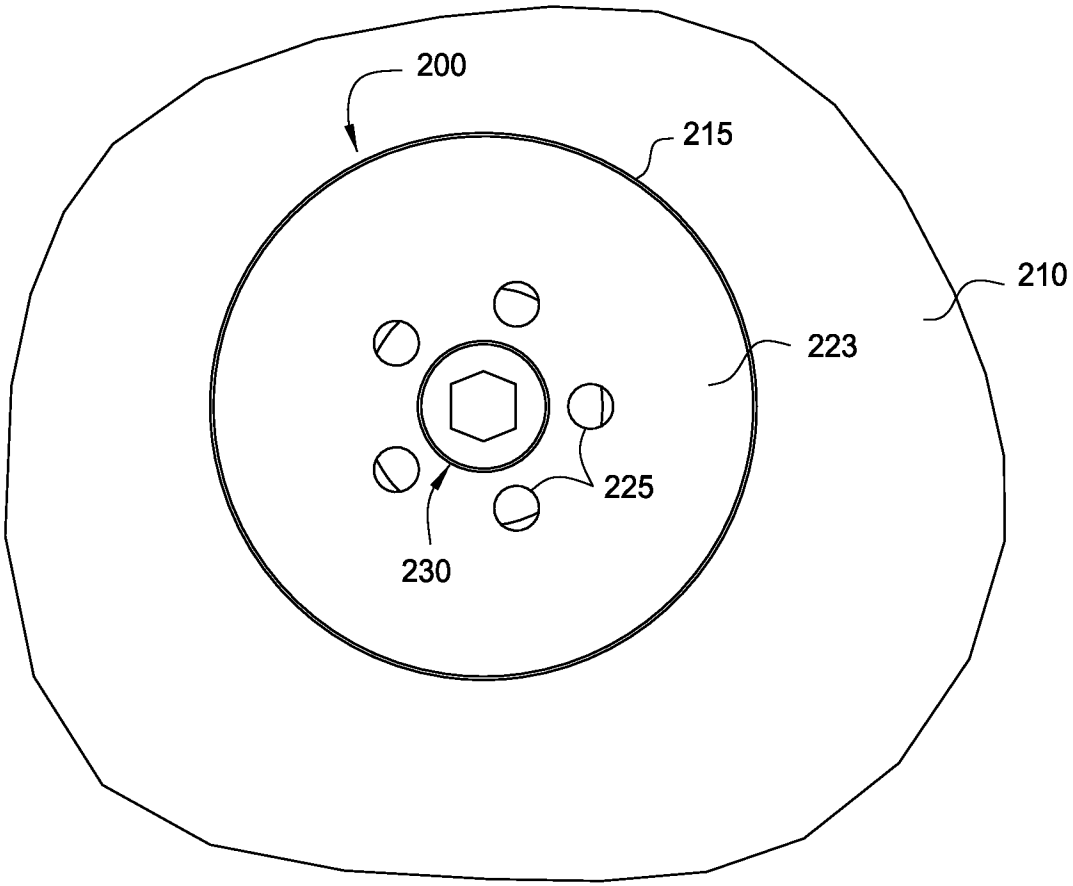
FIG. 6 is a top view of the valve assembly.

As shown in FIG. 6, a top view of the valve assembly 200 within the recess 215 illustrates a plurality of ports 225 radially disposed about the inner circumference of the cover member 223. The retaining member 230 is disposed through a central opening and is positioned within a recess of the cover member 223. Other retaining member 230, cover member 223, and biasing member 220 arrangements may be used with the embodiments described herein.

FIG. 5B illustrates the valve assembly 200 in the open position, where the bore 205 of the tubular mandrel 210 is in fluid communication with the annulus surrounding the valve assembly 200. The pressure in the annulus surrounding the valve assembly 200 may generate a force on the outer surfaces of the cover member 223, the retaining member 230, and/or the plug member 240 sufficient to overcome the closure force on the valve assembly 200. The closure force on the valve assembly 200 may include the force from the biasing member 220, such as a spring force, plus the force generated by any pressure within the bore 205 acting on the inner surface 245 of the plug member 240.

As illustrated in FIG. 5B, the biasing member 220 is compressed, and the cover member 223, the retaining member 230, and the plug member 240 are moved to open fluid communication to the bore 205 of the tubular mandrel 210. The plug member 240 is moved inwardly toward the bore 205 and away from contact with the valve seat 250. Fluid may flow through the ports 225 and between the plug member 240 and the valve seat 250 into the bore 205.

Figure 8:
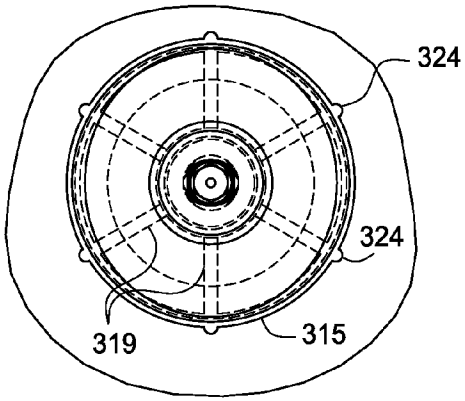
FIG. 8 is a top view of the valve assembly.
Figure 7B:
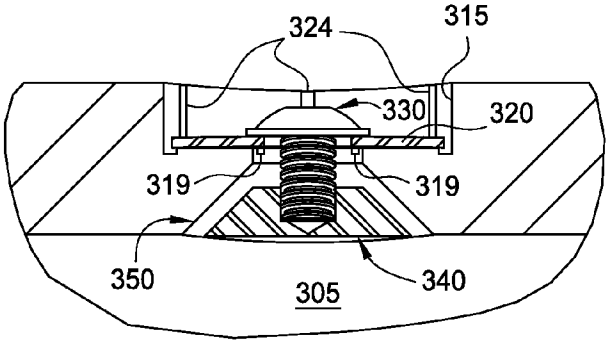
FIGS. 7A and 7B are cross sectional views of a valve assembly in a closed position and an open position.
Figure 7A:
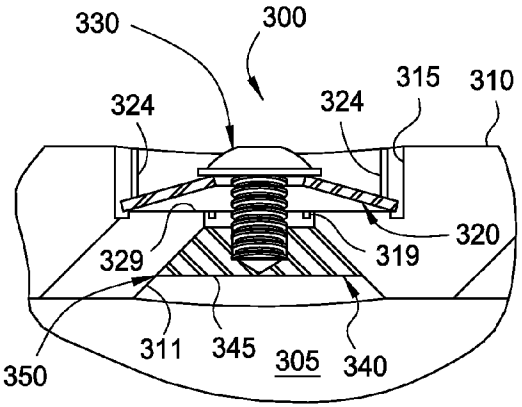

FIG. 7A illustrates a valve assembly 300 in a closed position, FIG. 7B illustrates the valve assembly 300 in an open position, and FIG. 8 illustrates a top view of the valve assembly 300. The valve assembly 300 operates in a similar manner as the valve assemblies 100, 200 and the similar components are identified with the same reference numerals but having a "300" series designation. The embodiments described herein with respect to each of the valve assemblies 100, 200, and 300 may be used interchangeably and/or combined with other embodiments.

The difference between the valve assembly 300 and the valve assemblies 100, 200 are the addition of one or more fluid passages 319, 324 that are formed in the body of the tubular mandrel 310. The fluid passages 319, 324 may be provided as an alternative or in addition to slots or the ports formed through the biasing member 330, such as slots 125 illustrated in FIG. 4 with respect to biasing member 130 for example. The fluid passages 319, 324 may be fluid channels or slots that are formed in the outer surface of the tubular mandrel 310 to direct fluid around the retaining member 330 and/or the biasing member 320. In one embodiment, the fluid passages 324 may be disposed along the longitudinal length of the recess 315 walls, and the fluid passages 319 may be disposed along a bottom surface 329 of the recess 315. The fluid passages 319, 324 are in communication with each other so that fluid may enter through the fluid passages 324 and exit through the fluid passages 319 into the bore 305 when the valve assembly 300 is in the open position. When the valve assembly 300 is in the closed position, pressurized fluid may act on the outer surface of the plug member 340 to overcome the closing force of the valve assembly 300 as described above with respect to the valve assemblies 100, 200.

Referring back to FIG. 1, the valve assemblies 100, 200, 300 may be operable to control fluid communication between the annulus A and the annulus B. The annulus A surrounds the valve assemblies 100, 200, 300 and the annulus B is in fluid communication with the bores of the valve assemblies 100, 200, 300. Pressure in the annulus A may act on the outer surfaces of the valve assemblies 100, 200, 300 to move the plug members 140, 240, 340 against the force of the biasing members 120, 220, 320 and any pressure force in the annulus B acting on the inner surface 145, 245, 345 of the plug members 140, 240, 340. When the valve assemblies 100, 200, 300 are open, pressurized fluid may flow from the annulus A to the annulus B through the slots 125, the ports 225, and/or the fluid passages 319, 324 and between the plug members 140, 240, 340 and the valve seats 150, 250, 350. The valve assemblies 100, 200, 300 are thus operable to relieve pressure and prevent any pressure differential that may cause burst or collapse of the casings 10, 20.

When the pressure in the annulus A and the force acting on the valve assemblies 100, 200, 300 decreases to a predetermined amount, the biasing members 120, 220, 320 may move the plug members 140, 240, 340 back to the closed position and into sealing engagement with the valve seats 150, 250, 350 to close fluid communication to the annulus B. In this manner, the valve assemblies 100, 200, 300 are operable as one-way valves in that they permit fluid flow into the bores of the valve assemblies 100, 200, 300 but will prevent fluid flow out of the bores into the annulus surrounding the valve assemblies 100, 200, 300. The valve assemblies 100, 200, 300 are automatically resettable downhole and may be operated multiple times in response to any pressure fluctuations within the wellbore 5. As stated above, any of the casings 10, 20, 30 and/or the tubular members 40, 45 may each be provided with one or more of the valve assemblies 100, the valve assemblies 200, and/or the valve assemblies 300 to allow fluid flow from a surrounding casing or tubular member to an inner casing or tubular member, while preventing fluid flow in the opposite direction. The valve assemblies 100, 200, 300 vent off collapse pressure from the outside of the casings 10, 20, 30 and/or tubular members 40, 45 but allow internal pressurization of the casings 10, 20, 30 and/or tubular members 40, 45. The internal pressure holding integrity of the casings 10, 20, 30 and/or tubular members 40, 45 is provided by the seal formed between the plug members 140, 240, 340 and the valve seats 150, 250, 350.

In one embodiment, a casing 10, 20, 30 and/or tubular member 40, 45 may be provided with multiple valve assemblies 100, 200, 300 that are spaced apart along the length of the casing or tubular member. The valve assemblies 100, 200, 300 may be positioned at one or more locations and/or depths within the wellbore 5 and below a wellhead disposed at the earth's surface. The valve assemblies 100, 200, 300 may be operable to open and/or close at different predetermined pressure settings. One or more of the valve assemblies 100, 200, 300 may be operable to open when a first predetermined pressure acts on the valve assembly 100, 200, 300 while one or more of the other valve assemblies 100, 200, 300 may be operable to open when a second predetermined pressure acts on the valve assembly 100, 200, 300. The first predetermined pressure may be greater than, less than, or equal to the second predetermined pressure.

In one embodiment, the valve assemblies 100, 200, 300 may be operable to vent and release pressure from within the bores of the valve assemblies 100, 200, 300 to an annulus or the environment surrounding the valve assemblies 100, 200, 300. For example, the valve assemblies 100, 200, 300 may be operable to vent pressure from the annulus B into the annulus A, as illustrated in FIG. 1. The valve assemblies 100, 200, 300 may prevent fluid flow in the reverse direction from the annulus A back into the annulus B.

While the foregoing is directed to embodiments of the invention, other and further embodiments of the invention may be devised without departing from the basic scope thereof, and the scope thereof is determined by the claims that follow.

The invention claimed is:

1. A valve assembly, comprising:

a casing having a seat portion and a sidewall;

a plug member at least partially disposed within the sidewall of the casing; and a biasing member operable to bias the plug member against the seat portion, wherein the biasing member includes one or more slots to facilitate fluid flow through the valve assembly, wherein the plug member is movable between a closed position where fluid communication is closed between a bore of the valve assembly and an annulus surrounding the valve assembly and an open position where fluid communication is open between the bore of the valve assembly and the annulus surrounding the valve assembly, and wherein the plug member is moved towards a bore of the casing to open fluid communication.

2. The valve assembly of claim 1, wherein the biasing member is operable to bias the plug member against the seat portion using a retaining member that is coupled to the plug member and in contact with the biasing member.

3. The valve assembly of claim 2, wherein the retaining member is recessed within the sidewall of the casing.

4. The valve assembly of claim 3, wherein an outer surface of the retaining member is substantially flush with an outer surface of the casing when in the closed position.

5. The valve assembly of claim 3, wherein an outer surface of the retaining member is entirely recessed within the sidewall of the casing such that the outer surface of the retaining member is offset from an outer surface of the casing.

6. The valve assembly of claim 1, wherein the plug member includes a tapered sealing surface for contact with a tapered sealing surface of the seat portion to form a seal.

7. The valve assembly of claim 1, wherein the biasing member is operable to bias the plug member against the seat portion using a cover member and a retaining member, wherein the retaining member is coupled to the plug member and the cover member, and wherein the cover member is in contact with the biasing member.

8. The valve assembly of claim 7, wherein the cover member includes one or more ports to facilitate fluid flow through the valve assembly.

9. The valve assembly of claim 1, wherein the casing includes one or more fluid passages to direct fluid flow around the biasing member and through the valve assembly.

10. The valve assembly of claim 1, wherein the plug member is entirely recessed within the sidewall of the casing when in the closed position.

11. The valve assembly of claim 10, wherein an inner surface of the plug member is substantially flush with an inner surface of the casing when in the closed position.

12. The valve assembly of claim 10, wherein an inner surface of the plug member is entirely recessed within the sidewall of the casing such that the inner surface of the plug member is offset from an inner surface of the casing.

13. The valve assembly of claim 1, wherein the plug member is entirely recessed within the sidewall of the casing when in the open position.

14. The valve assembly of claim 1, wherein the seat portion is formed by the sidewall of the casing.

15. A method of controlling fluid communication between an exterior of a casing and an interior of the casing, comprising:

coupling a valve assembly to the casing, wherein the valve assembly includes the casing, a plug member at least partially disposed within a sidewall of the casing, and a biasing member for biasing the plug member to a closed position, wherein the biasing member includes one or more slots to facilitate fluid flow through the valve assembly; and moving the plug member towards a bore of the casing to open fluid communication between the exterior of the casing and the interior of the casing in response to a predetermined pressure differential.

16. The method of claim 15, further comprising moving the plug member to the closed position using the biasing member to close fluid communication between the exterior of the casing and the interior of the casing.

17. The method of claim 16, further comprising controlling fluid flow through the casing using the plug member.

18. A valve assembly, comprising:

a tubular mandrel having a seat portion;

a plug member coupled to the tubular mandrel; and a biasing member operable to bias the plug member against the seat portion, wherein the plug member is movable between a closed position where fluid communication is closed between a bore of the valve assembly and an annulus surrounding the valve assembly and an open position where fluid communication is open between the bore of the valve assembly and the annulus surrounding the valve assembly, wherein the biasing member is operable to bias the plug member against the seat portion using a cover member and a retaining member, wherein the retaining member is coupled to the plug member and the cover member, and wherein the cover member is in contact with the biasing member.

19. The valve assembly of claim 18, wherein the cover member includes one or more ports to facilitate fluid flow through the valve assembly.

20. A valve assembly, comprising:

a tubular mandrel having a seat portion;

a plug member coupled to the tubular mandrel;

a retaining member coupled to the plug member; and a biasing member operable to bias the plug member against the seat portion, wherein the plug member is coupled to the biasing member by the retaining member, wherein the biasing member comprises a plurality of slots radially disposed about a center of the biasing member to facilitate fluid flow through the valve assembly, and wherein the plug member is movable between a closed position where fluid communication is closed between a bore of the valve assembly and an annulus surrounding the valve assembly and an open position where fluid communication is open between the bore of the valve assembly and the annulus surrounding the valve assembly.

21. A valve assembly, comprising:

a tubular mandrel having a sidewall, a plurality of fluid passageways, and a seat portion, wherein the plurality of fluid passageways comprises a first fluid passageway and a second fluid passageway formed in the sidewall;

a plug member coupled to the tubular mandrel; and a biasing member operable to bias the plug member against the seat portion, wherein the plug member is movable between a closed position where fluid communication is closed between a bore of the valve assembly and an annulus surrounding the valve assembly and an open position where fluid communication is open between the bore of the valve assembly and the annulus surrounding the valve assembly, and wherein the first fluid passageway is in fluid communication with the second fluid passageway when the plug member is in the closed position to direct fluid flow around the biasing member and through the valve assembly.

22. A valve assembly, comprising:

a casing having a seat portion and a sidewall;

a plug member at least partially disposed within the sidewall of the casing; and a biasing member operable to bias the plug member against the seat portion, wherein the plug member is movable between a closed position where fluid communication is closed between a bore of the valve assembly and an annulus surrounding the valve assembly and an open position where fluid communication is open between the bore of the valve assembly and the annulus surrounding the valve assembly, wherein the plug member is moved towards a bore of the casing to open fluid communication, and wherein the plug member includes a tapered sealing surface for contact with a tapered sealing surface of the seat portion to form a seal.

23. A valve assembly, comprising:

a casing having a seat portion and a sidewall;

a plug member at least partially disposed within the sidewall of the casing; and a biasing member operable to bias the plug member against the seat portion, wherein the plug member is movable between a closed position where fluid communication is closed between a bore of the valve assembly and an annulus surrounding the valve assembly and an open position where fluid communication is open between the bore of the valve assembly and the annulus surrounding the valve assembly, wherein the plug member is moved towards a bore of the casing to open fluid communication, and wherein the plug member is entirely recessed within the sidewall of the casing when in the closed position.

* * * * *